US010001100B2

(12) United States Patent
Agresta et al.

(10) Patent No.: US 10,001,100 B2
(45) Date of Patent: Jun. 19, 2018

(54) VALVE ASSEMBLY AND FLUID INJECTOR FOR A COMBUSTION ENGINE

(71) Applicant: Continental Automotive GmbH, Hannover (DE)

(72) Inventors: Antonio Agresta, Pisa (IT); Nicola Canesi, Pisa (IT); Luca Gestri, Cascina (IT); Marco Saliu, Sassari (IT); Luca Matteucci, Pisa (IT)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 306 days.

(21) Appl. No.: 14/595,676

(22) Filed: Jan. 13, 2015

(65) Prior Publication Data

US 2015/0198127 A1 Jul. 16, 2015

(30) Foreign Application Priority Data

Jan. 15, 2014 (EP) ..... 14151237

(51) Int. Cl.
*F02M 61/10* (2006.01)
*F02M 61/18* (2006.01)
(Continued)

(52) U.S. Cl.
CPC ..... *F02M 61/10* (2013.01); *F02M 61/045* (2013.01); *F02M 61/1886* (2013.01);
(Continued)

(58) Field of Classification Search
CPC ..... F02M 61/10; F02M 61/00; F02M 61/04; F02M 61/042; F02M 61/045; F02M 61/1886
See application file for complete search history.

(56) References Cited

U.S. PATENT DOCUMENTS 4,275,844 A * 6/1981 Grgurich ..... F02M 61/18 239/533.3
5,029,759 A * 7/1991 Weber ..... B23H 1/04 219/69.17
(Continued)

FOREIGN PATENT DOCUMENTS

DE 10020148 A1 11/2000 ..... F02F 1/24
DE 10163909 A1 7/2003 ..... F02M 61/06
(Continued)

OTHER PUBLICATIONS

European Office Action, Application No. 14151237.6, 6 pages, dated May 2, 2014.
(Continued)

*Primary Examiner* — Jacob Amick
(74) *Attorney, Agent, or Firm* — Slayden Grubert Beard PLLC

(57) ABSTRACT

A valve assembly for a fluid injector for an internal combustion engine includes a valve body with a valve recess, a central longitudinal axis, and a first axial end and a second axial end with respect to the central longitudinal axis. A valve needle is axially moveable within the valve recess with respect to the central longitudinal axis. In concurrence with a seal seat area the valve needle prevents a fluid flow through at least one flow hole in its closing position and otherwise enables it. Furthermore, the injector comprises a sac volume step adjacent to the seal seat area forming a part of an inner surface of a wall of the valve body and a sac volume being designed as one end of the valve recess and being limited by a further part of the inner surface of the wall of the valve body.

12 Claims, 3 Drawing Sheets

(51) Int. Cl.
*F02M 61/04* (2006.01)
*F02M 51/06* (2006.01)

(52) U.S. Cl.
CPC ..... *F02M 51/0664* (2013.01); *F02M 61/188* (2013.01); *F02M 61/1866* (2013.01); *F02M 2200/06* (2013.01)

(56) References Cited

U.S. PATENT DOCUMENTS 6,007,000 A * 12/1999 DeLuca ..... F02M 61/18 239/533.3
6,334,576 B1 * 1/2002 Cho ..... F02M 51/0671 239/5
7,077,340 B2 7/2006 Boecking ..... 239/533.12
2012/0043392 A1 * 2/2012 Agresta ..... F02M 51/066 239/1
2013/0008983 A1 * 1/2013 Soteriou ..... F02M 61/1893 239/584
2013/0270369 A1 * 10/2013 Peters ..... F02M 61/10 239/533.2

FOREIGN PATENT DOCUMENTS

DE 10313225 A1 10/2004 ..... F02M 45/08
DE 102008039920 A1 3/2010 ..... F02M 61/18
DE 102010032050 A1 1/2012 ..... F02M 61/18
EP 1988281 A1 11/2008 ..... F02M 21/02
EP 2369166 A1 9/2011 ..... F02M 61/06
WO 2004/040124 A1 5/2004 ..... F02M 61/18
WO 2012/084836 A1 6/2012 ..... F02M 61/16
WO 2012/143267 A1 10/2012 ..... F02M 61/18

OTHER PUBLICATIONS

Chinese Office Action, Application No. 201510019549.X, 16 pages, dated Nov. 21, 2017.

* cited by examiner

VALVE ASSEMBLY AND FLUID INJECTOR FOR A COMBUSTION ENGINE

CROSS-REFERENCE TO RELATED APPLICATIONS

This application claims priority to EP Patent Application No. 14151237.6 filed Jan. 15, 2014. The contents of which are incorporated herein by reference in their entirety.

TECHNICAL FIELD

The invention relates to a valve assembly for a fluid injector for an internal combustion engine, wherein the valve assembly comprises a valve body with a valve recess and central longitudinal axis.

BACKGROUND

Injectors are in widespread use, in particular for internal combustion engines, where they may be arranged in order to dose a fluid into an intake manifold of the internal combustion engine or directly into a combustion chamber of a cylinder of the internal combustion engine.

Due to increasingly strict legal regulations concerning the admissibility of pollutant emissions by internal combustion engines, which are arranged in vehicles for example, it is necessary to take action in various ways in order to reduce these pollutant emissions.

One possible starting point is to reduce the pollutant emissions which are directly produced by the combustion engine. For example after an injection process, when a valve needle has returned to its closing position, a remaining fuel volume inside an injector in the region of a nozzle tip can cause deposition of not combusted particles. This leads to high carbon- (also HC-) and particle number (also PN-) emissions, and thus is a challenge in order to fulfill legal regulations such as the European Emission Normative EU6C.

SUMMARY

One embodiment provides a valve assembly for a fluid injector for a combustion engine, the valve assembly comprising a valve body with a valve recess, a central longitudinal axis and a first axial end and a second axial end with respect to the central longitudinal axis, a valve needle being axially movable within the valve recess with respect to the central longitudinal axis and which prevents in concurrence with a seal seat area of the valve body a fluid flow through at least one flow hole in its closing position and otherwise enables it, a sac volume step adjacent to the seal seat area forming a part of an inner surface of a wall of the valve body, a sac volume being designed as one end of the valve recess and being limited by a further part of the inner surface of the wall of the valve body, and the further part of the inner surface extending away from the sac volume step towards the first axial end of the valve body, and at least one flow hole which penetrates the wall of the valve body in the region of the sac volume from the valve recess to an outside region of the valve body.

In a further embodiment, the sac volume step substantially extends parallel to the central longitudinal axis.

In a further embodiment, the sac volume step has a step height in the range between 0.01 mm and 0.15 mm, the limits being included, and a diameter of a free volume of the valve recess in the region of the sac volume step has a value in the range between 1.0 mm and 1.4 mm, the limits being included.

In a further embodiment, the inlet of the flow hole is arranged proximate to the sac volume step.

In a further embodiment, a distance between the inlet of the flow hole and the sac volume step is less than 0.1 mm.

In a further embodiment, the further part of the inner surface of the wall of the valve body limiting the sac volume comprises a conically shaped area adjacent to the sac volume step, wherein the conically shaped area has a decreasing distance to the central longitudinal axis in direction to the first axial end of the valve body.

In a further embodiment, the further part of the inner surface of the wall of the valve body limiting the sac volume comprises a flat shaped ground area adjacent to the conically shaped area, wherein the flat shape of the ground area is substantially perpendicular with respect to the central longitudinal axis.

In a further embodiment, the flat shaped ground area has a diameter having a value in the range from 0.4 mm to 0.8 mm, the limits being included.

In a further embodiment, the further part of the inner surface of the wall of the valve body limiting the sac volume comprises a spherically shaped ground area adjacent to the conically shaped area.

In a further embodiment, the spherically shaped ground area has a radius with a value in a range between 0.2 mm to 0.4 mm, the limits being included.

In a further embodiment, the further part of the inner surface of the wall of the valve body limiting the sac volume comprises a conically shaped ground area adjacent to the conically shaped area, wherein the conical shape of the conically shaped ground area differs from one of the conically shaped area and has a decreasing distance to the central longitudinal axis in direction to the first axial end of the valve body, and the further part of the inner surface of the wall of the valve body comprises a further spherically shaped part of the inner surface adjacent to the conically shaped ground area.

In a further embodiment, the cone angle of the conically shaped area has a value between 130° and 150°, whereas the cone angle of the conically shaped ground area has a value between 90° and 120°, and wherein the height of the conically shaped ground area is in the range from 0.2 mm to 0.4 mm.

In a further embodiment, the inlet of the flow hole is arranged in the conically shaped area of the sac volume.

Another embodiment provides a fluid injector for an internal combustion engine comprising a valve assembly as described above.

BRIEF DESCRIPTION OF THE DRAWINGS

Example embodiments of the invention are explained below with reference to the drawings, in which.

DETAILED DESCRIPTION

Figure 1:
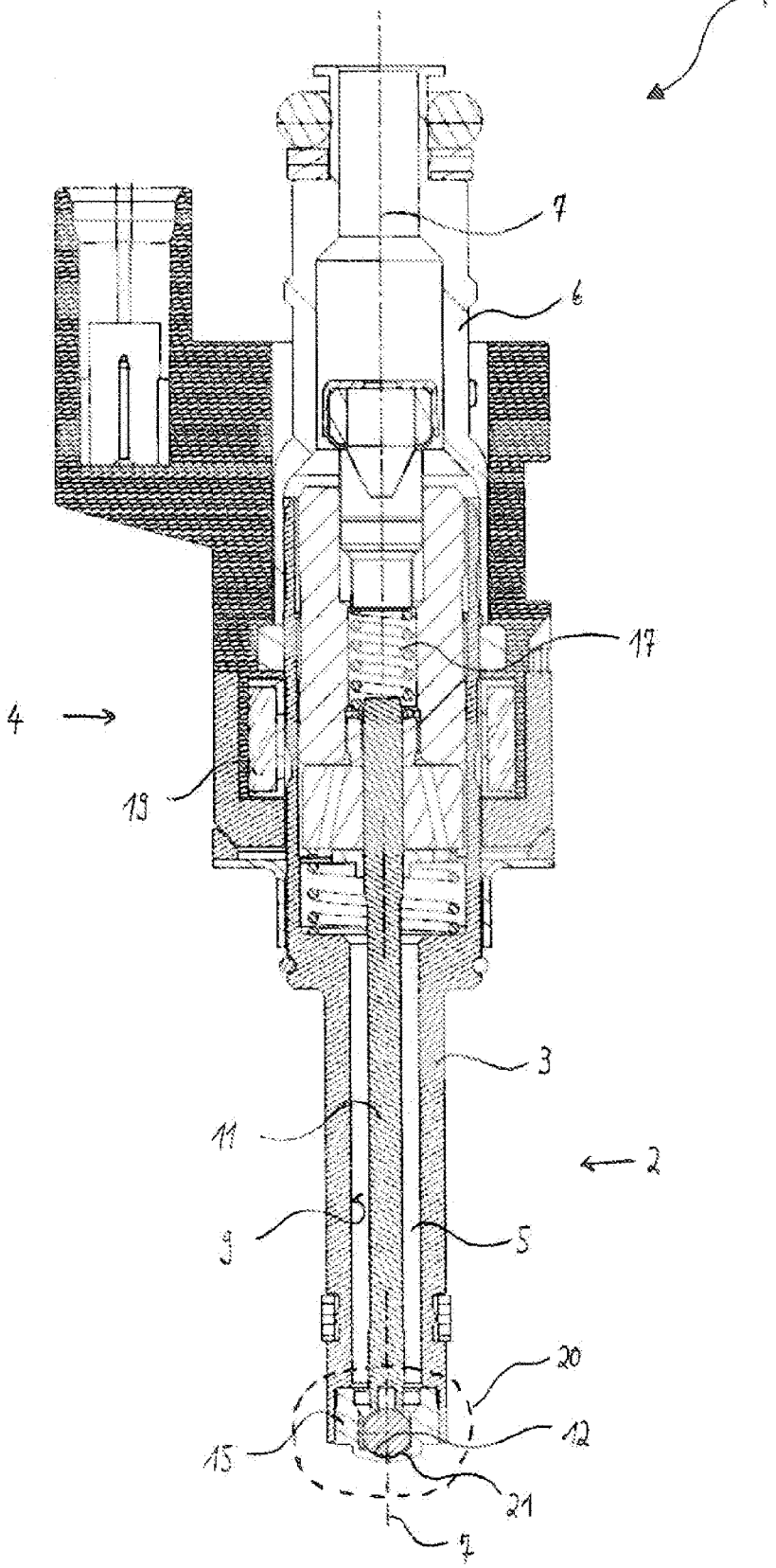
FIG. 1 shows an injector in a longitudinal section view.

Embodiments of the invention specify an injector for a combustion engine which facilitates a reliable and precise function and makes a contribution to particularly small pollutant emissions.

A valve assembly for a fluid injector for an internal combustion engine is specified. Further, a fluid injector for a combustion engine is specified, the fluid injector comprising the valve assembly and in particular an actuator. The fluid injector is in particular a fuel injector. It may preferably be provided for injecting fuel directly into a combustion chamber of the internal combustion engine.

The injector comprises a valve body with a valve recess, a central longitudinal axis and a first axial end and a second axial end with respect to the central longitudinal axis. Furthermore, the injector comprises a valve needle being axially movable within the valve recess with respect to the central longitudinal axis. The valve needle prevents, in concurrence with a seal seat area of the valve body, a fluid flow through at least one flow hole in its closing position and otherwise enables it. In particular, the valve needle is in mechanical contact with the seal seat area when the valve needle is in the closing position.

The valve body also comprises a sac volume step adjacent to the seal seat area and in particular downstream of the seal seat area. The sac volume step forms a part of an inner surface of a wall of the valve body. In other words, the sac volume step is defined by a section of an inner circumferential surface of the valve body.

Furthermore, the injector comprises a sac volume being designed as one end of the valve recess and being limited by a further part of the inner surface of the wall of the valve body. The further part of the inner surface extends away from the sac volume step towards the first axial end of the valve body. The injector comprises at least one flow hole which penetrates the wall of the valve body in the region of the sac volume from the valve recess to an outside region of the valve body.

This design of an injector for a combustion engine comprising a sac volume step in combination with the location of the respective flow hole enables advantageous flow field dynamics in the region of the sac volume. Hence it is advantageous for emptying the sac volume from remaining fuel after the valve needle has returned to its closing position and thus makes a contribution to reduce polluting emissions like high carbon emissions—also called HC-emissions—and particulate number emissions—also called PN-emissions. The sac volume step leads to turbulences of the flowing fluid so that the flow is not laminar anymore. For this reason some kinetic energy of the flowing fluid can be transferred to the remaining fuel in the sac volume and the effect of this is a contribution to an emptying of the sac volume. Yet another advantage of the reduction of remaining fuel in the region of the sac volume after the valve needle has returned to its closing position is obviating a nozzle tip wetting and hence reducing PN-emission.

According to one embodiment, the injector comprises a sac volume step which substantially extends parallel to the central longitudinal axis. For example, the distance of the inner circumferential surface of the valve body from the central longitudinal axis, in the course from the second axial end towards the first axial end, decreases in the region of the seal seat area, remains constant in the region of the sac volume step and then decreases further in the region of the further part of the inner surface. This orientation of the sac volume step allows for unique flow field dynamics and flow conditions for emptying the sac volume after the valve needle has returned to its closing position and makes a contribution to keep remaining fuel little inside the sac volume. A step height of the sac volume step is represented by an axial length of the sac volume step. The sac volume step may, for example, have a step height in the range between 0.01 mm and 0.15 mm, the limits being included.

According to a further embodiment, the inlet of the flow hole is arranged proximate to the sac volume step and, in particular, closer to the sac volume step than to the central longitudinal axis. In this context a distance between the inlet of the flow hole and the sac volume step may for example be less than 0.1 mm.

Such an arrangement of the flow hole is advantageous for the flow field dynamics and can further improve emptying the sac volume from the remaining fuel after the valve needle has returned to its closing position.

According to a further embodiment, the further part of the inner surface of the wall of the valve body which limits the sac volume comprises a conically shaped area adjacent to the sac volume step. In this context, the conically shaped area has a decreasing distance to the central longitudinal axis in the direction towards the first axial end of the valve body. A cone angle of the conically shaped area between 130° and 150°, the limits being included, is preferable for flow conditions of the flowing fluid.

Furthermore a first diameter of a free volume of the valve recess in the region of the sac volume step is represented by a geometrical distance of opposite sides of the sac volume step in reference to a cross section with respect to the central longitudinal axis. For example in the case of the sac volume step extending parallel to the central longitudinal axis, the first diameter may be in a range between 1.0 mm and 1.4 mm, the limits being included.

According to a further embodiment, the further part of the inner surface of the wall of the valve body limiting the sac volume comprises a flat shaped ground area adjacent to the conically shaped area. In this context, the flat shape of the ground area is substantially perpendicular with respect to the central longitudinal axis. For instance the size of the flat shaped ground area is distinguished by a second diameter. In this case the second diameter may be within the range from 0.4 mm to 0.8 mm, the limits being included.

According to a further embodiment, the further part of the inner surface of the wall of the valve body limiting the sac volume comprises a spherically shaped ground area adjacent to the conically shaped area. The size of the spherically shaped ground area is represented by its radius which also may be denoted as an indentation radius. Preferably the indentation radius is in between 0.2 mm to 0.4 mm. This allows for efficient energy transfer from the flowing fluid to the remaining fuel inside the sac volume after one injection process. Hence it is advantageous to the flow conditions for emptying the sac volume after the valve needle has returned to its closing position.

According to a further embodiment, the further part of the inner surface of the wall of the valve body limiting the sac volume comprises a conically shaped ground area adjacent to the conically shaped area. In this context, the conical shape of the conically shaped ground area has a different angle to the central longitudinal axis than the conically shaped area and has a decreasing distance to the central longitudinal axis in the direction towards the first axial end of the valve body. Preferably the cone angle of the conically shaped area is in between 130° and 150°, whereas the cone angle of the conically shaped ground area is in between 90° and 120°. Furthermore an advantageous height of the conically shaped ground area is in the range from 0.2 mm to 0.4 mm. In this context the height of the conically shaped ground area represents a geometrical length parallel to the central longitudinal axis from a point where the conical shape of the conically shaped area differs from the one of the conically shaped ground area to a point where the valve recess ends in the direction towards the first axial end of the valve body. Moreover, the further part of the inner surface of the wall of the valve body comprises a spherically shaped part of the inner surface adjacent to the conically shaped ground area limiting the sac volume. The spherically shaped part is, in other words, positioned subsequent to the conically shaped ground area in axial direction from the second towards the first axial end.

According to a further embodiment, the inlet of the flow hole of the injector is arranged in the conically shaped area of the sac volume. This positioning of the flow hole is advantageous for the remaining fuel to flow through the flow holes out of the valve body and hence for reliable emptying of the sac volume after an injection process when the valve needle has returned to its closing position.

It is particularly advantageous for flow conditions to prevent remaining fuel inside the sac volume after an injection process when, for example, the flow hole is arranged in the conically shaped area in combination with the sac volume step substantially extending parallel to the central longitudinal axis along with one special shape of the ground area comprising the further part of the inner surface of the wall of the valve body limiting the sac volume.

FIG. 1 shows an injector 1 with a nozzle assembly 2 and an actuator 4. The actuator 4 functionally interacts with the nozzle assembly 2.

The nozzle assembly 2 comprises a valve body. The valve body comprises a valve body part 3 and a nozzle tip body 15. The nozzle tip body 15 is fixedly coupled to the valve body part 3. Alternatively, the valve body part 3 and the nozzle tip body 15 can be a single piece. The actuator 4 comprises an injector body 6. The valve body part 3 is fixedly coupled to the injector body 6, for example by a nozzle clamping nut. The valve body part 3 and the injector body 6 form a common housing of the injector 1.

The valve body has a central longitudinal axis 7. It comprises a wall 9 which defines a valve recess 5. Furthermore the valve body comprises a first axial end and a second axial end, wherein the nozzle tip body 15 is positioned at the first axial end of the valve body. Within the valve recess 5, a valve needle 11 is arranged axially movable with respect to the central longitudinal axis relative to the valve body. The valve needle 11 has a round end portion 12 and is biased by a spring element 17. The round end portion 12 may be a ball which is fixed to a shaft of the valve needle 11 at the axial end of the valve needle 11 which faces towards the first axial end of the valve body.

The actuator 4 has a coil 19 for generating a magnetic field. The actuator 4 is operable to actuate the valve needle 11 by means of the magnetic field such that the valve needle 11 can perform a movement along a direction of the central longitudinal axis 7 against the bias of the spring element 17.

The nozzle tip body 15 limits a free volume of the valve recess 5. The nozzle tip body 15 comprises at least one flow hole 13. In other words, the nozzle tip body 15 closes the valve recess 5 at the first axial end, except for the at least one flow hole 13.

The nozzle tip body 15 further comprises a seal seat area 21, in which the valve needle 11 sealingly rests with its round end portion 12 in its closing position due to forces acting on it, amongst others one force being a spring force by the spring element 17. Details of the nozzle tip body 15 will be explained below with reference to FIGS. 2 to 5.

Depending on a force balance of the forces acting on the valve needle 11, in particular comprising the spring force of the spring element 17 and the force transferred to the valve needle 11 by the actuator 4, the valve needle 11 is movable out of its closing position and into its closing position to enable or prevent a flow of a fluid through the flow hole 13. One actuating force is exerted by the spring element 17 in direction of the closing position. Another actuating force is exerted by the coil 19 in order to move the valve needle 11 out of its closing position towards an opening position. A hydraulic force is a further force acting on the valve needle 11 which may be exerted by the fluid in direction to the closing position of the valve needle 11, in particular due to pressure differences. The fluid may be for example gasoline or diesel.

In FIGS. 2 to 5 described below, enlarged views of a region 20 of FIG. 1 are shown, which show exemplary constructional designs of the nozzle tip body 15.

Figure 2:
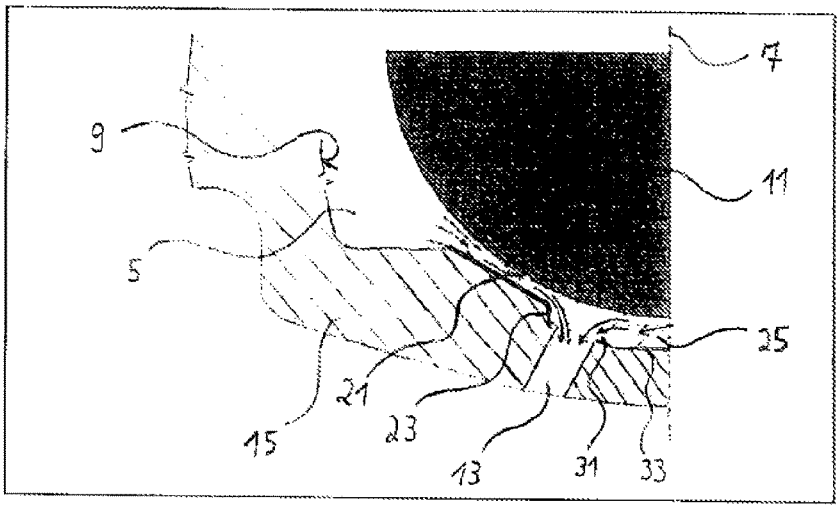
FIG. 2 shows an enlarged side view of a nozzle tip body of the injector.

In FIG. 2 an enlarged view of the region 20 of FIG. 1 is shown which exhibits an exemplary constructional design of the nozzle tip body 15 of the injector 1. The enlarged view is a longitudinal section view of the nozzle tip body 15.

The valve needle 11 prevents, in concurrence with the seal seat area 21 a fluid flow through the flow hole 13 in its closing position and otherwise enables it. In other words, the round end portion 12 of the valve needle 11 abuts the seal seat area 21 when the valve needle 11 is in the closing position to prevent fluid flow through the flow hole 13. The actuator 4 is operable to displace the valve needle 11 axially towards the second axial end of the valve body for establishing a gap between the seal seat area 21 and the round end portion 12 for enabling fluid flow from the second axial end through the gap to the flow hole 13 and further through the flow hole 13 out of the valve body.

During an injection process fluid flows in the direction from the second axial end towards the first axial end of the valve body in a free volume of the valve recess 5. Thereupon the fluid passes the seal seat area 21 and afterwards a sac volume step 23, which forms a part of an inner surface of the wall 9 of the valve body. One fraction of the fluid can directly pass the inlet of the flow hole 13 and exit the valve body to an outside area of the injector 1. Another, in particular small, fraction of the fluid enters a sac volume 25, which is designed as one end of the valve recess 5 and which is limited by a further part of the inner surface of the wall 9 of the valve body. Due to the sac volume step 23, flow conditions change and the flow of the fluid is not laminar anymore. Turbulences develop and influence the fluid flow dynamics which is advantageous for a further flow of the fluid.

Fuel remaining inside the sac volume 25 after the valve needle 11 has returned into contact with the seal seat area 21 may cause pollutant emissions. Because of the introduced turbulent flow generated by the sac volume step 23, some kinetic energy of the flowing fluid can be transferred to the remaining fuel inside the sac volume 25. This kinetic energy of the remaining fuel promotes dispensing a particularly large portion of the remaining fluid—or preferably of the complete remaining fluid—through the flow hole 13 out of the valve body of the injector 1.

In this way, the sac volume step 23 makes a contribution to empty the sac volume 25 after the valve needle 11 has returned to its closing position and therefore reduces the risk for a nozzle tip wetting and for pollutant emissions. For generating advantageous flow conditions, it is preferable that the sac volume step 23 extends substantially parallel to the central longitudinal axis 7 and that the flow hole 13 is placed close to the sac volume step 23 as shown in FIG. 2.

Figure 3:
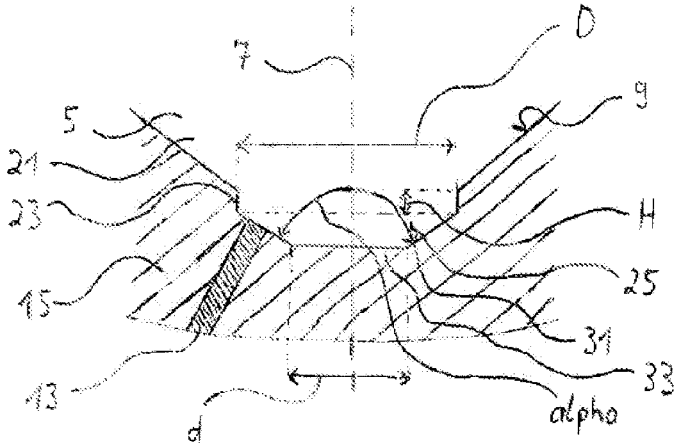
FIG. 3 shows one exemplary embodiment of the sac volume of the injector.

In FIG. 3, a furthermore enlarged view of the region 20 of the injector 1 in FIG. 1 is shown and in particular a detailed view of the inner surface of the sac volume 25.

In this exemplary embodiment the sac volume step 23 adjacent to the seal seat area 21 is substantially extending parallel to the central longitudinal axis 7. A conically shaped area 31 adjacent to the sac volume step 23 has a decreasing distance to the central longitudinal axis 7 in the direction of the first axial end of the valve body. The conically shaped area 31 has a cone angle alpha. In one advantageous embodiment, the cone angle alpha of the conically shaped area 31 is in between 130° to 150°. A first diameter D of a free volume of the valve recess 5 in the region of the sac volume step 23 is represented by a geometrical distance of opposite sides of the sac volume step 23 in reference to a cross section with respect to the central longitudinal axis 7. Preferably the first diameter D is in between 1.0 mm to 1.4 mm. Moreover a ground area 33 adjacent to the conically shaped area 31 forms a further part of the inner surface of the wall 9 of the valve body limiting the sac volume 25. In this exemplary embodiment, the ground area 33 has a flat shape defined by a portion of the inner surface of the wall 9 of the valve body. The size of the ground area 33 can be characterized by a second diameter d, for example. In this context one advantageous embodiment would comprise a second diameter d in between 0.4 mm to 0.8 mm. Furthermore the sac volume step 23 is distinguished by a step height H, and the step height H of the sac volume step 23 may be within a range from 0.01 mm to 0.15 mm.

This specific design of the sac volume step 23 adjacent to the seal seat area 21 and the sac volume 25 adjacent to the sac volume step 23 is one advantageous embodiment to generate special fluid flow dynamics and hence enables reliable emptying of the sac volume 25 after an injection process when the valve needle 11 has returned to its closing position and hence obviates a nozzle tip wetting.

Figure 4:
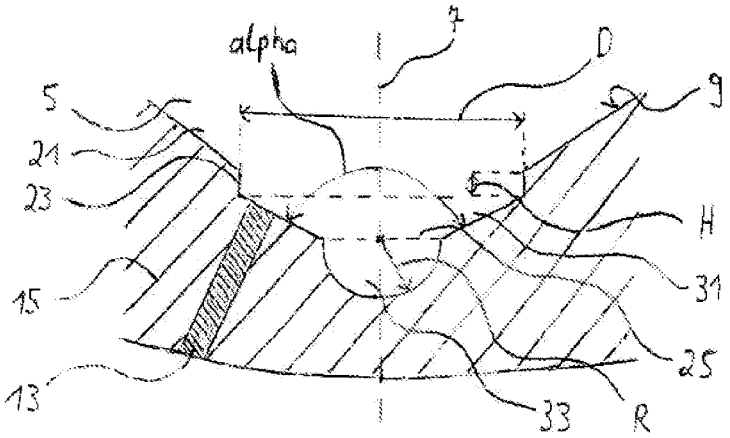
FIG. 4 shows another exemplary embodiment of the sac volume of the injector.

In FIG. 4 a detailed view of the region 20 of the injector 1 according to another exemplary embodiment for a shape of the sac volume 25 is shown.

In this embodiment, the ground area 33 comprises a further spherically shaped part of the inner surface of the wall 9 of the valve body instead of the flat shape of the previous embodiment. As in the previous embodiment, the inlets of the flow holes 13 (of which only one is shown in the figures) are positioned within the conically shaped area 31 which laterally surrounds the ground area 33. The spherical shape of the ground area 33 allows for unique flow field dynamics to enhance emptying of the sac volume 25 and reduce remaining fuel inside the injector 1. The spherically shaped ground area 33 can have a radius R. In an advantageous embodiment, the radius R has a value between 0.2 mm and 0.4 mm.

Figure 5:
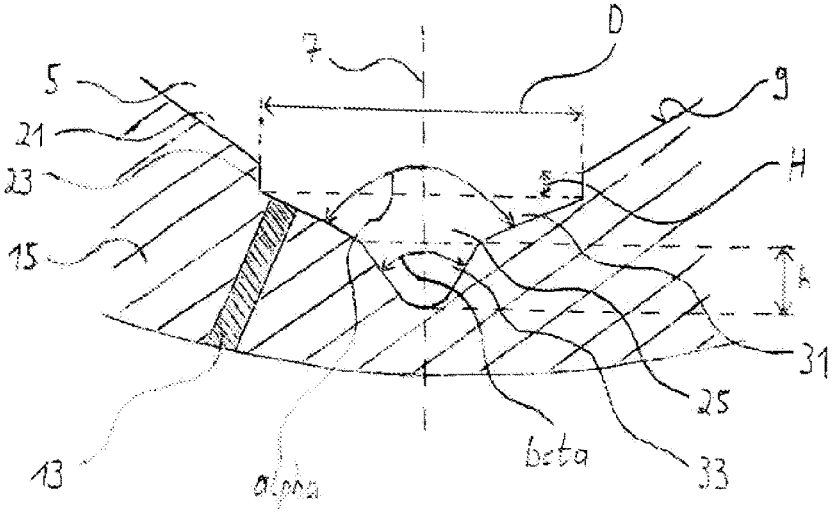
FIG. 5 shows another exemplary embodiment of the sac volume of the injector.

In FIG. 5 yet another shape of the sac volume 25 is shown. The ground area 33 of the present sac volume 25 comprises a further conically shaped part of the inner surface of the wall 9 of the valve body forming the ground area 33. The further conically shaped part is located adjacent to—and in particular adjoining—the conically shaped area 31. Adjacent to the further conically shaped part on its side remote from the conically shaped area 31, the ground area 33 comprises a spherically shaped part of the inner surface of the wall 9 of the valve body 3 to limit the sac volume 25 in the direction to the first axial end of the valve body 3.

The conically shaped ground area 33 has a cone angle beta. Preferably the cone angle beta of the conically shaped ground area 33 is in between 90° to 120°. This specific design of the sac volume 25 is one possibility which allows for unique flow field dynamics for emptying the sac volume 25 from remaining fuel.

What is claimed is:

1. A valve assembly for a fluid injector for a combustion engine, the valve assembly comprising:

a valve body with a valve recess, a central longitudinal axis and a first axial end and a second axial end with respect to the central longitudinal axis, a valve needle with a round end portion comprising at least a portion of a spherical ball, the valve needle axially movable within the valve recess with respect to the central longitudinal axis to prevent, via contact with a seal seat area of the valve body, fluid flow through at least one flow hole in a closing position of the valve needle, and allows fluid flow through the at least one flow hole in other positions of the valve needle, a sac volume step adjacent to the seal seat area forming a part of an inner surface of a wall of the valve body, a sac volume at one end of the valve recess, the sac volume limited by a further part of the inner surface of the wall of the valve body, wherein the further part of the inner surface extends away from the sac volume step towards the first axial end of the valve body, and at least one flow hole that penetrates the wall of the valve body in a region of the sac volume from the valve recess to an outside region of the valve body;

wherein the further part of the inner surface of the wall of the valve body limiting the sac volume comprises a conically shaped area adjacent to the sac volume step, wherein the conically shaped area has a decreasing distance to the central longitudinal axis in a direction to the first axial end of the valve body;

wherein the further part of the inner surface of the wall of the valve body limiting the sac volume comprises a spherically shaped ground area adjacent to the conically shaped area; and wherein inlets for the at least one flow hole are disposed within the conically shaped area of the further part of the inner surface.

2. The valve assembly of claim 1, wherein the sac volume step extends substantially parallel to the central longitudinal axis.

3. The valve assembly of claim 2, wherein the sac volume step has a step height in the range of between 0.01 mm and 0.15 mm, inclusive, and a diameter of a free volume of the valve recess in the region of the sac volume step has a value in the range of between 1.0 mm and 1.4 mm, inclusive.

4. The valve assembly of claim 1, wherein the inlet of the flow hole is arranged proximate to the sac volume step.

5. The valve assembly of claim 3, wherein a distance between the inlet of the flow hole and the sac volume step is less than 0.1 mm.

6. The valve assembly of claim 1, wherein the further part of the inner surface of the wall of the valve body limiting the sac volume comprises a flat shaped ground area adjacent to the conically shaped area, wherein the flat shape of the ground area is substantially perpendicular with respect to the central longitudinal axis.

7. The valve assembly of claim 6, wherein the flat shaped ground area has a diameter having a value in the range from 0.4 mm to 0.8 mm, inclusive.

8. The valve assembly of claim 1, wherein the spherically shaped ground area has a radius with a value in a range between 0.2 mm to 0.4 mm, inclusive.

9. The valve assembly of claim 1, wherein:

the further part of the inner surface of the wall of the valve body limiting the sac volume comprises a conically shaped ground area adjacent to the conically shaped area, wherein the conical shape of the conically shaped ground area differs from one of the conically shaped area and has a decreasing distance to the central longitudinal axis in a direction to the first axial end of the valve body, and the further part of the inner surface of the wall of the valve body comprises a further spherically shaped part of the inner surface adjacent to the conically shaped ground area.

10. The valve assembly of claim 9, wherein:

the cone angle of the conically shaped area has a value between 130° and 150°, the cone angle of the conically shaped ground area has a value between 90° and 120°, and a height of the conically shaped ground area is in the range from 0.2 mm to 0.4 mm.

11. A fluid injector for an internal combustion engine, comprising:

a valve assembly comprising:

a valve body with a valve recess, a central longitudinal axis and a first axial end and a second axial end with respect to the central longitudinal axis, a valve needle with a round end portion comprising at least a portion of a spherical ball, the valve needle axially movable within the valve recess with respect to the central longitudinal axis to prevent, via contact with a seal seat area of the valve body, fluid flow through at least one flow hole in a closing position of the valve needle, and allows fluid flow through the at least one flow hole in other positions of the valve needle, a sac volume step adjacent to the seal seat area forming a part of an inner surface of a wall of the valve body, a sac volume at one end of the valve recess, the sac volume being limited by a further part of the inner surface of the wall of the valve body, wherein the further part of the inner surface extends away from the sac volume step towards the first axial end of the valve body, and at least one flow hole that penetrates the wall of the valve body in a region of the sac volume from the valve recess to an outside region of the valve body;

wherein the further part of the inner surface of the wall of the valve body limiting the sac volume comprises a conically shaped area adjacent to the sac volume step, wherein the conically shaped area has a decreasing distance to the central longitudinal axis in a direction to the first axial end of the valve body;

wherein the further part of the inner surface of the wall of the valve body limiting the sac volume comprises a spherically shaped ground area adjacent to the conically shaped area; and wherein inlets for the at least one flow hole are disposed within the conically shaped area of the further part of the inner surface.

12. An internal combustion engine, comprising:

a plurality of fluid injectors, each fluid injectors including a valve assembly comprising:

a valve body with a valve recess, a central longitudinal axis and a first axial end and a second axial end with respect to the central longitudinal axis, a valve needle with a round end portion comprising at least a portion of a spherical ball, the valve needle axially movable within the valve recess with respect to the central longitudinal axis to prevent, via contact with a seal seat area of the valve body, fluid flow through at least one flow hole in a closing position of the valve needle, and allows fluid flow through the at least one flow hole in other positions of the valve needle, a sac volume step adjacent to the seal seat area forming a part of an inner surface of a wall of the valve body, a sac volume at one end of the valve recess, the sac volume being limited by a further part of the inner surface of the wall of the valve body, wherein the further part of the inner surface extends away from the sac volume step towards the first axial end of the valve body, and at least one flow hole that penetrates the wall of the valve body in a region of the sac volume from the valve recess to an outside region of the valve body;

wherein the further part of the inner surface of the wall of the valve body limiting the sac volume comprises a conically shaped area adjacent to the sac volume step, wherein the conically shaped area has a decreasing distance to the central longitudinal axis in a direction to the first axial end of the valve body;

wherein the further part of the inner surface of the wall of the valve body limiting the sac volume comprises a spherically shaped ground area adjacent to the conically shaped area; and wherein inlets for the at least one flow hole are disposed within the conically shaped area of the further part of the inner surface.

* * * * *